US007970104B2

(12) United States Patent
Kaika et al.

(10) Patent No.: US 7,970,104 B2
(45) Date of Patent: Jun. 28, 2011

(54) BEARING UNIT FOR ROTARY ANODES OF X-RAY TUBES

(75) Inventors: Wolfgang Kaika, Nuremberg (DE); Stefan Tritthart, Nuremberg (DE); Thomas Maussner, Nuremberg (DE)

(73) Assignee: Paul Mueller GmbH & Co. KG Unternehmensbeteiligungen, Nürnberg (DE)

( * ) Notice: Subject to any disclaimer, the term of this patent is extended or adjusted under 35 U.S.C. 154(b) by 0 days.

(21) Appl. No.: 12/225,902

(22) PCT Filed: Apr. 3, 2007

(86) PCT No.: PCT/DE2007/075004

§ 371 (c)(1), (2), (4) Date: Dec. 18, 2008

(87) PCT Pub. No.: WO2008/019682

PCT Pub. Date: Feb. 21, 2008

(65) Prior Publication Data

US 2009/0129548 A1 May 21, 2009

(30) Foreign Application Priority Data

Apr. 4, 2006 (EP) ..... 06007156

(51) Int. Cl.
*H01J 35/10* (2006.01)
*H01J 35/08* (2006.01)

(52) U.S. Cl. ..... 378/132; 378/144

(58) Field of Classification Search ..... 378/119, 378/121, 125, 132, 133, 143, 144
See application file for complete search history.

(56) References Cited

U.S. PATENT DOCUMENTS

| | | | | |
|---|---|---|---|---|
| 3,699,373 | A * | 10/1972 | Holland et al. | 378/132 |
| 4,914,684 | A * | 4/1990 | Upadhya | 378/133 |
| 5,076,381 | A * | 12/1991 | Daido et al. | 180/446 |
| 6,445,770 | B1 * | 9/2002 | Wandke et al. | 378/132 |
| 6,693,990 | B1 * | 2/2004 | Andrews | 378/132 |
| 2003/0165217 | A1 | 9/2003 | Ratzmann et al. | |
| 2003/0197360 | A1 * | 10/2003 | Shimizu | 280/771 |
| 2004/0070297 | A1 * | 4/2004 | Yoon et al. | 310/90 |

FOREIGN PATENT DOCUMENTS

| | | |
|---|---|---|
| DE | 30 41 558 | 6/1982 |
| DE | 87 05 478 | 8/1988 |
| DE | 100 17 777 | 10/2001 |
| JP | 8-042564 | 2/1996 |

OTHER PUBLICATIONS

International Search Report.

* cited by examiner

*Primary Examiner* — Anastasia Midkiff
(74) *Attorney, Agent, or Firm* — Collard & Roe, P.C.

(57) ABSTRACT

The invention relates to a bearing unit (1) for rotary anodes of X-ray tubes, with a shaft (2) and a flange element (3), to which a rotary anode can be attached, wherein the bearing unit (1) can be inserted into a cutout within the X-ray tube and locked there. The shaft (2) is held via a first and a second bearing element (4, 5), wherein the first bearing element (4) comprises an inner race (6) fitted on the shaft (2) and a separate outer ring (7). The second bearing element (5) comprises a roller bearing fitted on the shaft (2) with an inner ring (8) and an outer ring (9), wherein a spacer element (10) is fitted between the outer rings (7, 8) of the first and the second bearing element (4, 5).

7 Claims, 1 Drawing Sheet

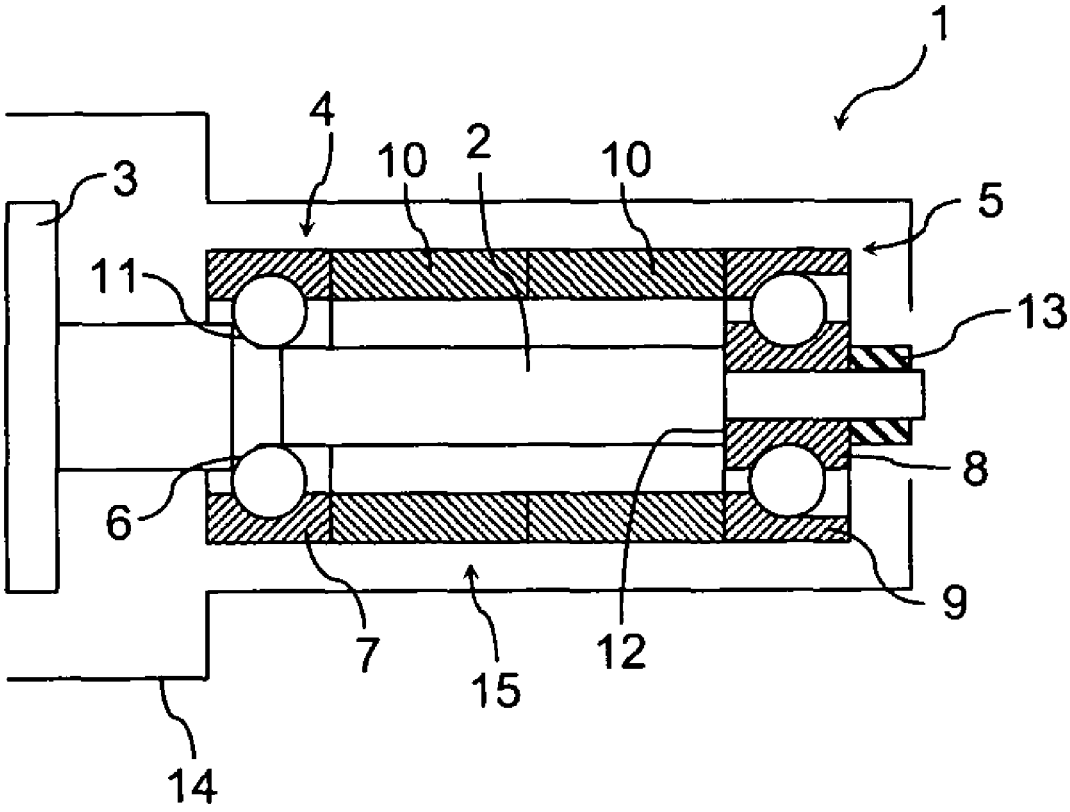
1
4
10
2
10
3
5
11
13
8
6
9
7
12
15
14

BEARING UNIT FOR ROTARY ANODES OF X-RAY TUBES

CROSS REFERENCE TO RELATED APPLICATIONS

This application is the National Stage of PCT/DE2007/075004 filed on Apr. 3, 2007, which claims priority under 35 U.S.C. §119 of European Application No. 06007156.0 filed on Apr. 4, 2006. The international application under PCT article 21(2) was not published in English.

BACKGROUND OF THE INVENTION

1. Field of the Invention

The invention relates to a bearing unit for rotary anodes of x-ray tubes.

2. Description of the Prior Art

From DE 30 41 558 A1, for example in FIG. 1 of the drawings, a bearing unit for rotary anodes of x-ray tubes is known, wherein the rotary anode is accommodated in a partially illustrated evacuated glass bulb.

SUMMARY OF THE INVENTION

The object of the invention is to produce a bearing unit for rotary anodes of x-ray tubes of this type, which is particularly easy to assemble.

This object is attained with a bearing unit with a shaft and a flange element, to which a rotary anode can be attached, wherein the bearing unit can be inserted into a recess inside an x-ray tube, where it can be fixed in place, the shaft is held by a first and a second bearing element, wherein the first bearing element comprises an inner track mounted on the shaft and a separate outer ring, the second bearing element comprises a roller bearing attached to the shaft, with an inner ring and an outer ring, wherein a spacer element is fitted between the outer rings of the first and the second bearing element. Advantageous embodiments are discussed below. The bearing unit according to the invention is compact in structure and consists of a small number of parts, which can be preassembled, so that the preassembled bearing unit can be inserted into the corresponding recess in the x-ray tube, in an easy-to-assemble fashion.

According to one advantageous embodiment, the shaft has a single-sided shoulder on its inner track, so that a separate inner ring of a roller bearing is no longer required. The single-sided shoulder can also absorb any axial forces that may occur.

According to a further advantageous embodiment, the inner ring of the roller bearing rests against a step on the shaft, and is thereby fixed in place in an axial direction, in an easy-to-assemble fashion.

By mounting the roller bearing using especially a form-fitting, tapered caulking element, once the bearing element has been attached to the shaft the roller bearing can be locked in position, thereby allowing the entire bearing unit to be fixed in place in a simple manner.

According to one advantageous embodiment, the outer ring of the first bearing element can be configured as a single-shoulder bearing, with the shoulder being located especially on the side that faces away from the flange element. This step serves to improve the ease of assembly of the bearing unit.

According to a further advantageous embodiment, the outer ring of the additional bearing element can also be configured as a single-shoulder bearing, so as to also achieve ease of assembly for the roller bearing.

Especially, the outer rings of the two bearing elements can be configured with single-shoulder bearings, wherein each of the shoulders is located on the inner side, facing the spacer element.

Configuring the first bearing element as a deep-groove ball bearing also makes it possible for the first bearing element to absorb axial forces to a certain extent.

According to a further advantageous embodiment, at least two spacer elements can be provided between the outer rings of the bearing elements, wherein, for example, a first (e.g., larger) spacer element, produced according to standard dimensions, can be used, and one or more spacer disks, produced according to precise measurements, can also be used to fill in the desired distance between the outer rings of the bearing elements.

BRIEF DESCRIPTION OF THE DRAWINGS

The invention is specified in greater detail with reference to the exemplary embodiment represented in the drawing.

The sole FIGURE shows a bearing unit in accordance with an embodiment of the invention.

DETAILED DESCRIPTION OF THE PREFERRED EMBODIMENTS

The represented bearing unit 1 comprises a shaft 2 with a flange element 3, to which a rotary anode (e.g., according to DE 30 41 558 A1) can be attached.

The entire bearing unit 1 can then be inserted into a recess 15 in the x-ray tube 14, provided for this purpose, where it can be fixed in place in the customary manner (e.g., via screw attachment).

For accommodating the shaft 2, the bearing unit 1 has a first bearing element 4 and a second bearing element 5, wherein the first bearing element 4 has an outer ring 7 and the inner track 6 is located on the shaft 2.

The second bearing element 5 is formed by a roller bearing attached to the shaft 2, which bearing has an inner ring 8 and an outer ring 9. The outer rings 7 and 9 are spaced according to precise measurements via a spacer element 10.

As described, it is also possible for a plurality of spacer elements 10 to be provided between the outer rings 7, 9 of the first and second bearing elements 4, 5.

The inner track 6 of the shaft 2 has a single-sided shoulder 11. The inner ring 8 of the roller bearing rests against the step 12 of the shaft 2.

The mounted bearing unit 1 is held in place via the attached caulking element 13.

LIST OF REFERENCE SYMBOLS

1 Bearing unit
2 Shaft
3 Flange
4 First bearing element
5 Second bearing element
6 Inner track
7 Outer ring
8 Inner ring
9 Outer ring
10 Spacer element
11 Shoulder
12 Step
13 Caulking element

The invention claimed is:

1. An assembly comprising an x-ray tube having a rotary anode and a bearing unit for the rotary anode, said bearing unit comprising a shaft and a flange element, to which the rotary anode is attached, wherein:

the bearing unit is inserted into a recess inside the x-ray tube, where it is fixed in place;

the shaft is held by a first and a second bearing element, wherein:

the shaft has an inner track having a single-sided shoulder;

the first bearing element comprises a separate first outer ring;

the second bearing element comprises a roller bearing attached to the shaft, said roller bearing comprising an inner ring and a second outer ring;

wherein a spacer element is fitted between the first and second outer rings; and wherein the shaft has a first diameter at a first side of the shaft adjoining the flange element and a second diameter less than the first diameter at a second side of the shaft away from the flange element so that the first bearing element, the spacer element, and the second bearing element can be assembled on the shaft by sliding the first bearing element, the spacer element, and the second bearing element on the shaft from the second side.

2. The assembly according to claim 1, wherein the inner ring of the roller bearing rests against a step of the shaft.

3. The assembly according to claim 1, wherein the roller bearing is fastened to the shaft via a caulking element.

4. The assembly according to claim 1, wherein the first outer ring is configured as a single-shoulder bearing.

5. The assembly according to claim 1, wherein the second outer ring is configured as a single-shoulder bearing.

6. The assembly according to claim 1, wherein the first bearing element is configured as a deep-groove ball bearing.

7. The assembly according to claim 1, wherein at least two spacer elements are provided between the first and second outer rings.

* * * * *